US005927580A

United States Patent [19]

Ward-Llewellyn

[11] Patent Number: 5,927,580

[45] Date of Patent: Jul. 27, 1999

[54] QUICK RELEASE LATERAL CLOSURE SYSTEM

[76] Inventor: Terence P. Ward-Llewellyn, 2124 Cold Stream Ct., Oxnard, Calif. 93030

[21] Appl. No.: 08/871,594

[22] Filed: Jun. 9, 1997

Related U.S. Application Data

[63] Continuation-in-part of application No. 08/581,842, Jan. 2, 1996, abandoned.

[51] Int. Cl.[6] ..... A45F 5/00

[52] U.S. Cl. ..... 224/272; 224/194; 224/269; 224/901.8; 224/904; 224/908; 224/930; 24/3.1; 24/304; 24/460; 24/666

[58] Field of Search ..... 224/901, 271, 224/272, 678, 674, 269, 194, 666, 901.8, 908, 930, 904; 24/3.1, 304, 666, 667, 460, 462, 3.12, 3.11, 3.6

[56] References Cited

U.S. PATENT DOCUMENTS

| | | | |
|---|---|---|---|
| 252,448 | 1/1882 | Flatau | 224/271 |
| 267,714 | 11/1882 | Petmecky | 224/271 |
| 867,255 | 10/1907 | Dietz | 24/3.6 |
| 904,968 | 11/1908 | Kocher | 224/194 |
| 1,489,244 | 4/1924 | Gnegy | 24/3.12 |
| 3,929,266 | 12/1975 | Kim | 224/272 |
| 4,554,710 | 11/1985 | Grant | 24/304 |
| 5,331,721 | 7/1994 | Raum, Sr. | 24/304 |
| 5,375,749 | 12/1994 | Oliva | 224/271 |

FOREIGN PATENT DOCUMENTS

| | | | |
|---|---|---|---|
| 3017803 | 12/1980 | Germany | 24/667 |

*Primary Examiner*—Linda J. Sholl
*Attorney, Agent, or Firm*—Kenneth J. Hovet

[57] ABSTRACT

A quick release connector system is provided for interconnecting a frequently used portable accessory item with a support body. The system utilizes a clasp having a back wall spaced apart from a stationary wall. The stationary wall includes an enlarged opening from which extends a slot. A deflectable wall overlies the enlarged opening. A connector part forms the quick release connection with the clasp. It is attached to the portable accessory item via a post with an enlarged head. The post has a diameter less than the width of the slot and the head has a diameter greater than the width of the slot, but less than the enlarged opening. When the deflectable wall is flexed away from the enlarged opening, the head of the connector part will pass through the opening and slide behind the slot as the post is moved into the slot. The enlarged head behind the slot will prevent axial disengagement. Upon returning to its original unflexed position, the deflectable wall will prevent the post from moving laterally out of the slot. To disengage the connector part and accessory item from the clasp, the deflectable wall is flexed away from the enlarged opening and the process is reversed. The clasp may comprise a strip of material bent about 180 degrees with the ends of the strip enclosed by a cup part. Alternatively, an endless loop of flexible material may be partially flattened to form the stationary wall and back wall. In this version, cuts are made into the stationary wall to define a deflectable wall, an enlarged opening and a slot opening below the deflectable wall.

11 Claims, 4 Drawing Sheets

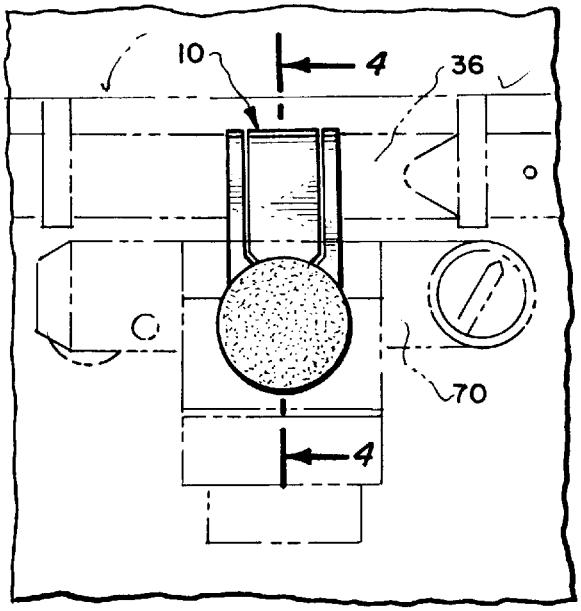
Fig. 1.
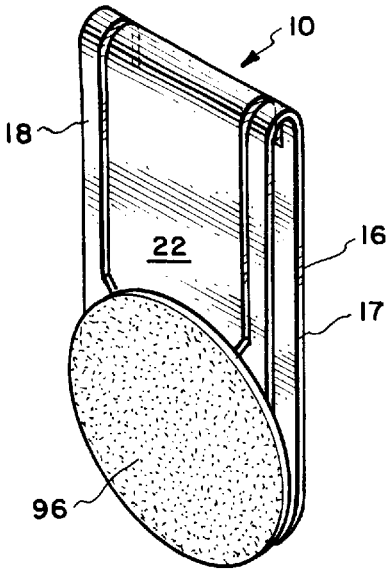
Fig. 3.
Fig. 2.
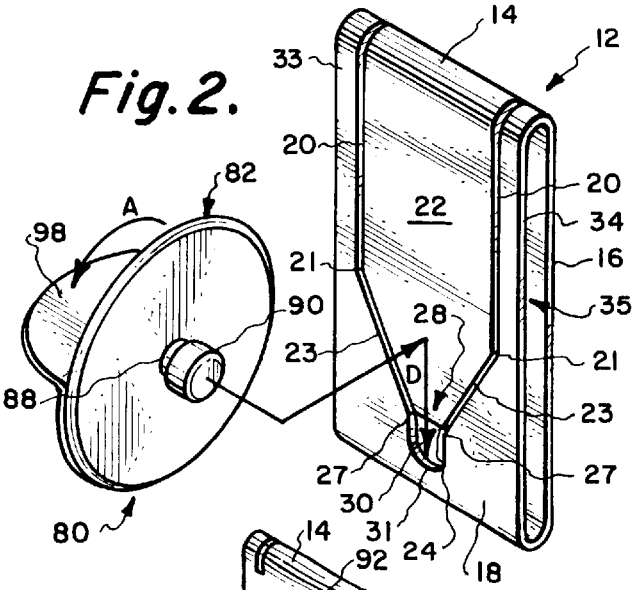
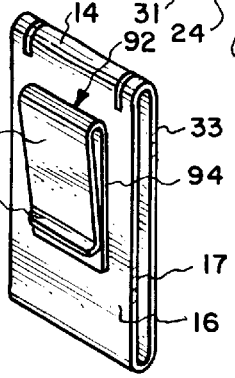
Fig. 3a.
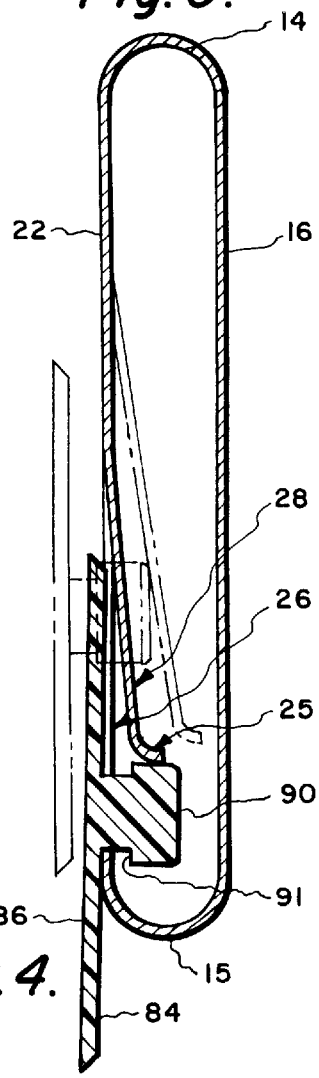
Fig. 4.

QUICK RELEASE LATERAL CLOSURE SYSTEM

This application is a continuation-in-part of application Ser. No. 08/581,842, filed Jan. 2, 1996, now abandoned.

BACKGROUND OF THE INVENTION

1. Field of the Invention

The present invention pertains to lateral closure systems. More particularly, the invention relates to a quick release clasp and connector part for interconnecting an accessory item to a support body.

2. Description of Related Art

Lateral closures utilizing a deflectable flap guarding a narrow slot within which is deployed a stud piece is shown in U.S. Pat. Nos. 420,041, 681,699, 723,234, 1,390,776 and 1,463,949. The above art was developed for use in securing together parts of clothing. In particular, lateral closures were used to connect adjacent parts of a corset or for attaching the ends of suspenders to a pair of trousers. With corsets, the fastener part of the closure is secured to a steel strip along the corset edge. The stud part of the closure is hooked to a corresponding adjacent strip. The strips are used to pull the corset together and the array of lateral closures on the strip uniformly hold the corset strips together.

A disadvantage of the garment closures is that they were designed to hold parts of clothing drawn together under tension. In effect, they were replacements for drawstrings or stitches. As such, they were designed as releasable securement means and were primarily used in multiple units. They were not thought of as being independent means for interconnecting separate objects. Also, the closure parts were permanently attached to the garment parts. Thus, they were not intended to be independently portable.

SUMMARY OF INVENTION

The present invention provides a closure system for interconnecting an accessory item to a support body such as one's belt, shirt, pack, strap, vehicle dashboard, clipboard, table or wall. In its most basic form, a clasp means is formed comprising a back wall connected to a stationary wall and a deflectable wall. The stationary wall includes a slot having a predetermined width which communicates with an enlarged opening. The opening has a diameter greater than the width of the slot. The deflectable wall includes a guard portion which obstructs access to the enlarged opening.

Interacting with the deflectable wall is a connector means having a post with a diameter less than the slot width. The post includes an enlarged head which has a diameter less than the diameter of the enlarged opening, but greater than the width of the slot. When the deflectable wall is flexed away from the enlarged opening, the enlarged head passes through the enlarged opening and the post is then moved into the slot. When the deflectable wall returns to its unflexed condition, the end of the deflectable flap will prevent the post from moving out of the slot. To disengage the connector means, the deflectable wall is again flexed away from the enlarged opening and the above procedure is reversed.

The connector means is provided with attachment means for securement to an accessory item such as a camera, pager, portable phone, tool implement, flashlight and the like. Therefore, movement of the connector means constitutes movement of the accessory item.

The back wall and stationary wall of the clasp means may comprise a single strip of material bent into a J-shape. In this version, the shortest forward part of the strip would comprise the stationary wall and include the enlarged opening and slot. The longest back part would be the back wall. A deflectable wall would then incline from the back wall and overlie the back side of the enlarged opening.

In another version, the strip of flexible material may be bent into a U-shape to create the back wall and the deflectable wall. In this variation, a cup part having front and rear walls is attached to the end portion of the back wall. The cup part front wall is then used as the stationary wall to provide the aforementioned enlarged opening and slot.

Alternatively, the clasp means may simply comprise an endless loop of flexible material which has been partially flattened. The flattened sections provide the respective back wall and stationary wall. Cuts are made in the stationary wall to provide the deflectable wall. The same cuts may create the slot and enlarged opening.

BRIEF DESCRIPTION OF THE DRAWINGS

FIG. 1 is a front elevation view of a clasp and connector part attached to each other and to a respective support body and accessory item shown in phantom respectively as a belt and camera.

FIG. 2 is an exploded front perspective view of the clasp and connector part of FIG. 1 illustrating movement of the connector part into engagement with the clasp.

FIG. 3 is a front perspective view of the connector part and clasp of FIG. 2 engaged with each other.

FIG. 3*a* is a rear perspective view of the clasp of FIG. 3 showing an alternative securement means.

FIG. 4 is an enlarged cross-sectional view taken along lines 4—4 of FIG. 1 showing in phantom the flexure of the deflectable wall when the enlarged head extends through the enlarged opening.

DESCRIPTION OF THE PREFERRED EMBODIMENTS

Figure 5:
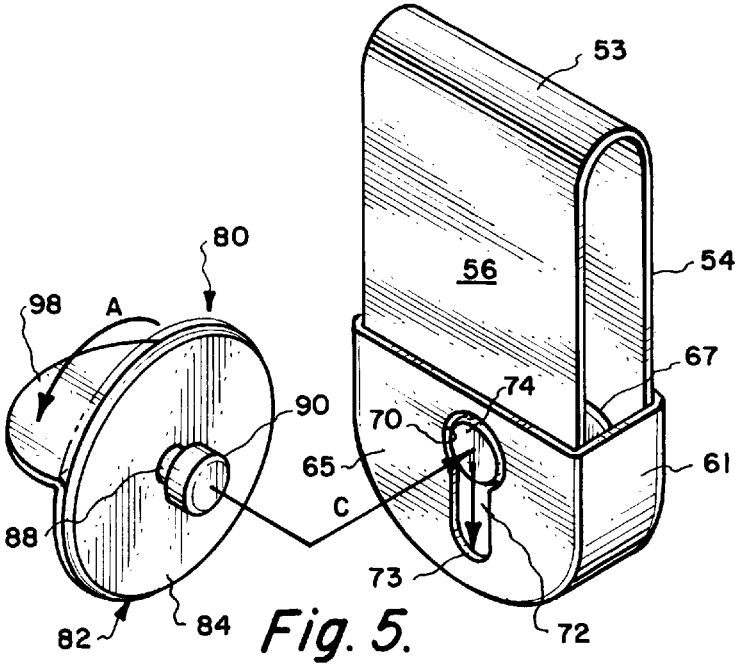
FIG. 5 is an exploded front perspective view of a variation of the clasp showing movement of the connector part into engagement with the modified clasp.

With reference now to FIGS. 1–4 of the drawings, the closed loop version 10 of the invention is shown. This version is characterized by the use of a clasp means 12 which is formed from an endless loop of flexible material. The loop comprises a thin, flat strip which, when partially flattened, forms a rounded top end 14 and a rounded bottom end 15. The flattened sections of the loop which extend between the top and bottom ends comprises back wall 16 and stationary wall 18. The stationary wall and back wall present spaced-apart flat structures.

Stationary wall 18 includes opposing cuts which define a deflectable wall 22 and an enlarged opening 26. The cuts come together at the lower portion of the stationary wall to create a cut-out area referenced as slot 30.

In the embodiment shown, cuts 20,20 begin at adjacent side edges 33,34 of the stationary wall and extend across the top end of the clasp. They extend parallel to the side edges downwardly to mid-corners 21,21 at about the wall mid-portion. They then converge inwardly as inclined cuts 23,23 to slot corners 27,27. Extending between the slot corners is terminal end 24 of the deflectable wall. For a purpose to be hereinafter described, the terminal end may be flared inwardly to provide an abutment end structure 25.

The cuts extend downwardly and parallel to side edges 33,34 from the slot corners for a predetermined distance. They then curve inwardly and merge to define closed end 31 of slot 30. The width of the slot is less than the enlarged opening 26 from which it extends The area above terminal end 24 and a lower portion of the converging cuts 23,23 provide a part of the outline of enlarged opening 26. For purposes of explanation, the enlarged opening shall be defined as that area above terminal end 24 and between the converging cuts which is exposed when deflectable wall 22 is flexed away from the plane of stationary wall 18. Because the cuts diverge from opposing slot corners 27,27, the diameter of the enlarged opening will progressively increase. Therefore, as used herein, the diameter of the enlarged opening shall be a predetermined amount which is greater than the width of terminal end 24 and less than the distance between mid-corners 21,21. The part of the deflectable wall that encloses the enlarged opening is referenced as guard portion 28.

As shown, cuts 20,20 are spaced from respective side edges 33,34 of the stationary wall an equal distance. Cuts 23,23 incline at equal angles and come toward each other to the slot corners which are an equal distance from the median line of the clasp. They again continue parallel to side edges 33,34 and then curve inwardly and merge to define the above-described slot 30. As so configured, the slot, enlarged opening and deflectable wall are all bilaterally symmetrical.

It will be noted that the cuts 20,20 extend across the top end and down a short distance of the back wall. This permits easier flexure of the deflectable wall. However, the cuts could terminate short of the top end depending on such variables as the thickness of the stationary wall, its flexural characteristics and the wall composition. For example, in the embodiment shown, the cuts are suitable for use with a metallic material such as stainless steel. In the case of a plastic strip or a thinner metal, the cuts may be shorter and not extend up to the top end.

The closed loop construction of the clasp provides an inner passageway 35 so that the clasp itself may function as a means for engagement with a support body. In FIG. 1, the support body is shown in phantom as belt 36. The belt extends through the passageway so that the clasp can hang therefrom and operate in a manner to be hereinafter described.

It will be appreciated that other securement means may be used to attach the clasp to a support body. Most typically these would extend from back wall 16 and may comprise a variety of means known in the art such as bolt and nut, screw fasteners, magnets, snaps, hook and looped fabric cloth fasteners, adhesives and rivets. The particular securement means being used will, of course, be dictated by the support body to which the clasp is being secured.

FIG. 3*a* illustrates the use of a clip 92 as a securement means. The clip includes an attachment part 94 which may be welded, bonded or mechanically fastened to the back wall outer face mid-portion. Extending outwardly and downwardly from the upper end of the attachment part is flex part 93. An arcuate lower portion 95 of the flex part is biased against a corresponding lower area of the attachment part. As so constructed, the clip can hang over the edges of a support body such as a belt, strap or pocket and be held thereto by the pinching action between the attachment part lower area and the flex part arcuate lower portion.

In the case where the clasp is secured to an article of clothing, reference may be made to FIGS. 10–13. Therein, bottom end 15 of the clasp shown in FIGS. 1–4 is provided with end notches 42,43. The notches are used to permit engagement with an auxiliary plate 38. As shown, the auxiliary plate is provided with opposing inwardly directed side flanges 39,40. The flanges define inner corners 44,45 which are spaced apart a distance greater than the width of the clasp back wall.

Figure 12:
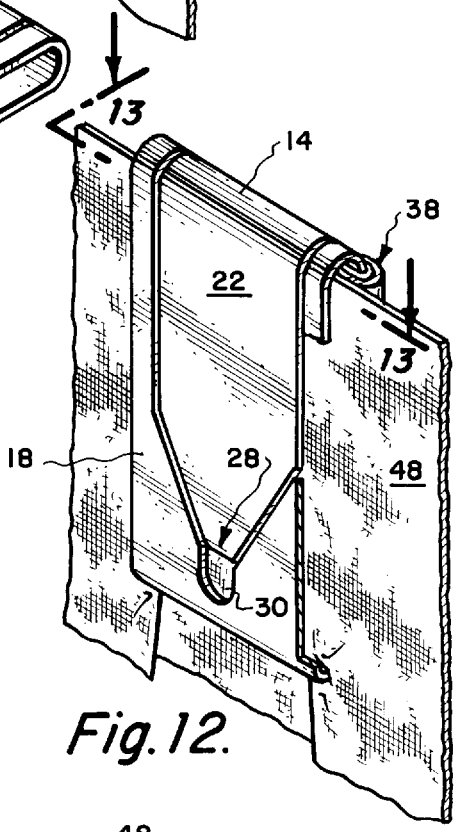
FIG. 12 is a front perspective view showing engagement of the modified clasp and assembled auxiliary plate and fabric segment of FIG. 11 with a broken-away portion along the right edge of the modified clasp.
Figure 13:
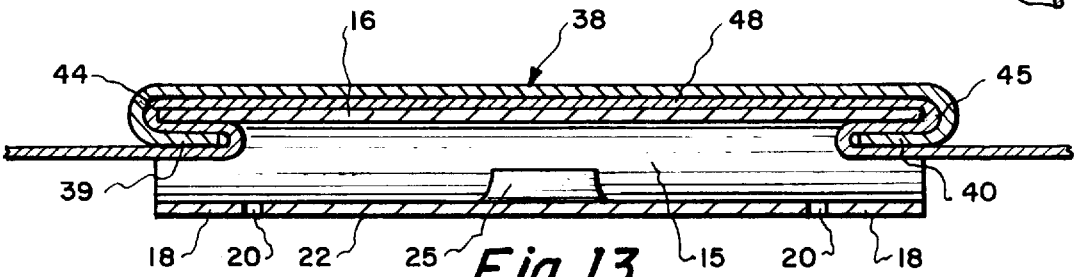
FIG. 13 is an enlarged cross-sectional view taken along lines 13—13 of FIG. 12.

In use, the auxiliary plate may be positioned behind any portion of a flexible cloth-like material. As shown, it is positioned behind the pocket of a garment referenced as fabric fragment 48. The fabric is gathered in an amount sufficient to line the inner face 46 and inner corners 44,45 of the plate. The pocket edge 49 is aligned with upper edge 50 of the plate. Thereafter, notches 42,43 are aligned with respective flanges as shown by arrow B in FIG. 11. The clasp is then moved downwardly over the combined auxiliary plate and fabric until upper edge 50 of the plate engages clasp top end 14. FIGS. 12 and 13 show the plate and fabric in the fully engaged position.

Operating in conjunction with the clasp means is a connector means shown as accessory connector part 80. The connector part functions to releasably interconnect an accessory item, to which it is attached, to the clasp means. The clasp means, in turn, is attached to the aforementioned support body so that an overall releasable connection is made between the support body and an accessory item.

In the embodiment shown in FIGS. 1–7, the connector part comprises a base plate 82 having a front face 84 and a rear face 86. The plate comprises a circular, thin piece of rigid material constructed of plastic or metal. The plate may have other geometrical configurations such as polygonal structures, cross bars, web structures or it may simply comprise an extension of the post described below.

Extending from the center axis of front face 84 is post 88. The post extends outwardly a distance at least greater than the thickness of the stationary wall. It has a diameter that is less than the width of the slot and terminates with an enlarged head 90.

Although the enlarged head could have a polygonal or triangular shape, the head shown has a circular configuration with an inner shoulder 92. It has a diameter which is less than the diameter of enlarged opening 26 and a diameter that is greater than the width of slot 30. In this way, when the post is within the slot, shoulder 92 of the head will prevent axial movement of the connector part out of the slot.

The base plate also includes attachment means for securing the plate to an accessory item such as the camera 78 shown in phantom in FIG. 1. In FIGS. 1–7, the attachment means comprises an adhesive coating 96 over the rear face 86 of the plate. The coating is initially protected by an overlay material 98. As shown by arrow A in FIGS. 2 and 5, the material is removed when the base plate is ready to be secured to an accessory item.

Figure 8:
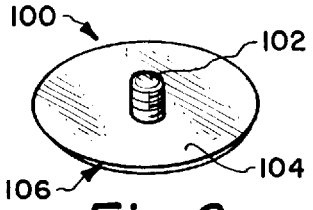
FIG. 8 is a front side perspective view of an alternative accessory connector means.
Figure 9:
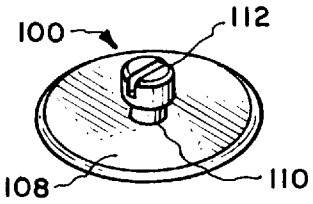
FIG. 9 is a back side perspective view of the accessory connector means shown in FIG. 8.
Figure 10:
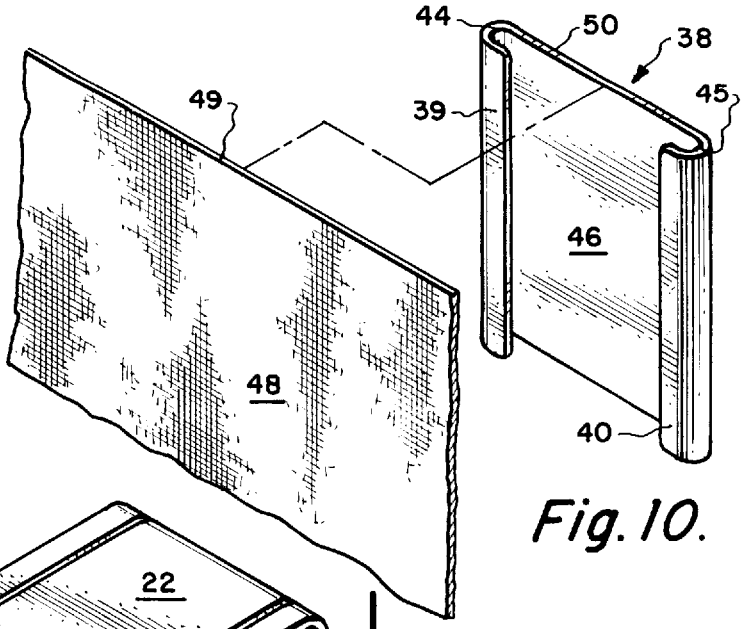
FIG. 10 is an exploded front perspective view of a securement means showing an auxiliary plate and a segment of fabric from a garment.
Figure 11:
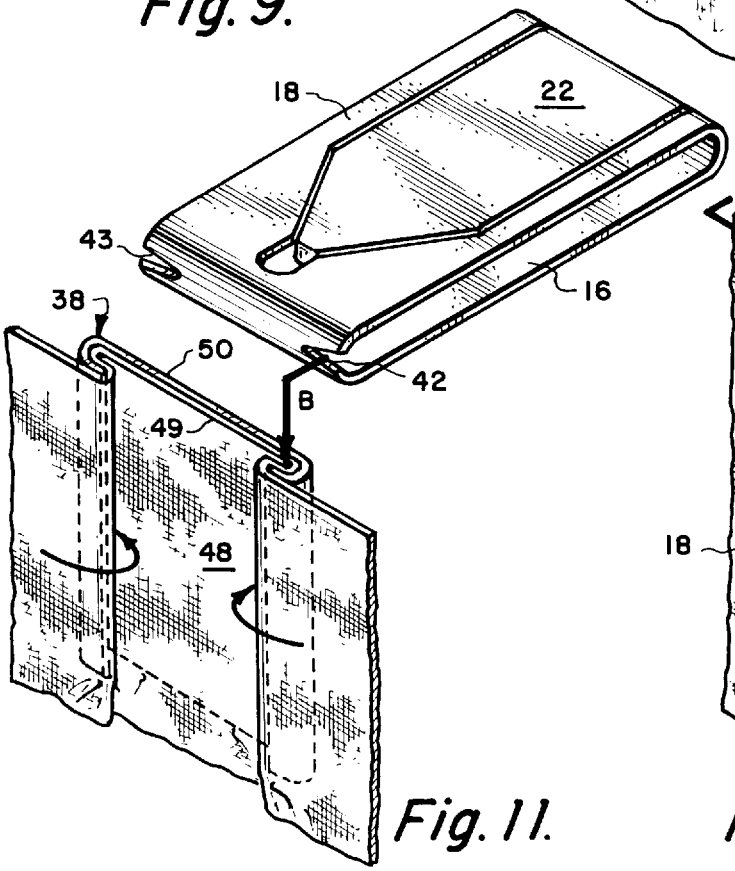
FIG. 11 is an exploded front perspective view showing the assembled auxiliary plate and fabric segment of FIG. 10 being engaged with a modified version of the clasp shown in FIGS. 1–4.

FIGS. 8 and 9 show an alternative accessory connector part 100. This part is similar to connector 80 except the post, enlarged head and accessory attachment means simply comprise a single threaded bolt. In this alternative, a plate is not necessary. However, as shown, the bolt extends partially through a disc 106 center axis. This results in a threaded shaft 102 that extends outwardly from accessory face 104 of the disc. Extending axially from boss face 108 is shank 110 having a slotted head 112 at its outer end.

Particularly when the invention is to be used as a camera carrying means, the shaft threads are sized to engage corresponding tripod engagement threads in the camera housing. In all other respects, the alternative connector part functions in the same way as the previously described connector means.

Figure 6:
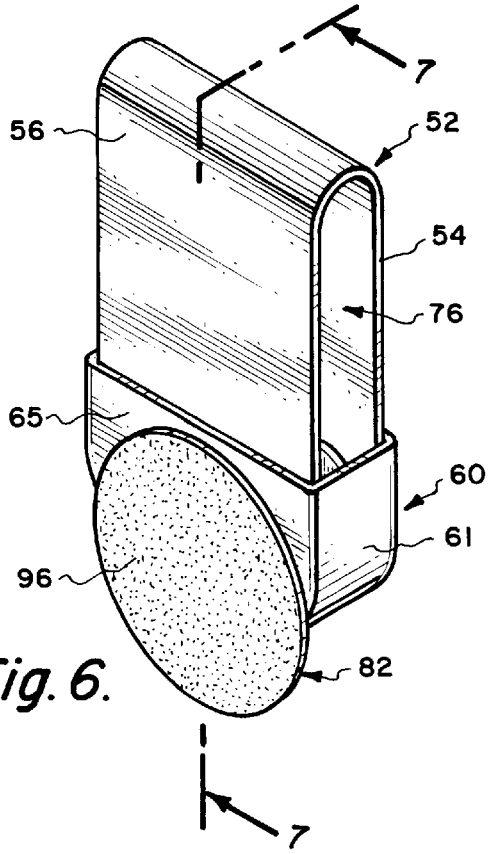
FIG. 6 is a front perspective view of the connector part and clasp of FIG. 5 engaged with each other.
Figure 7:
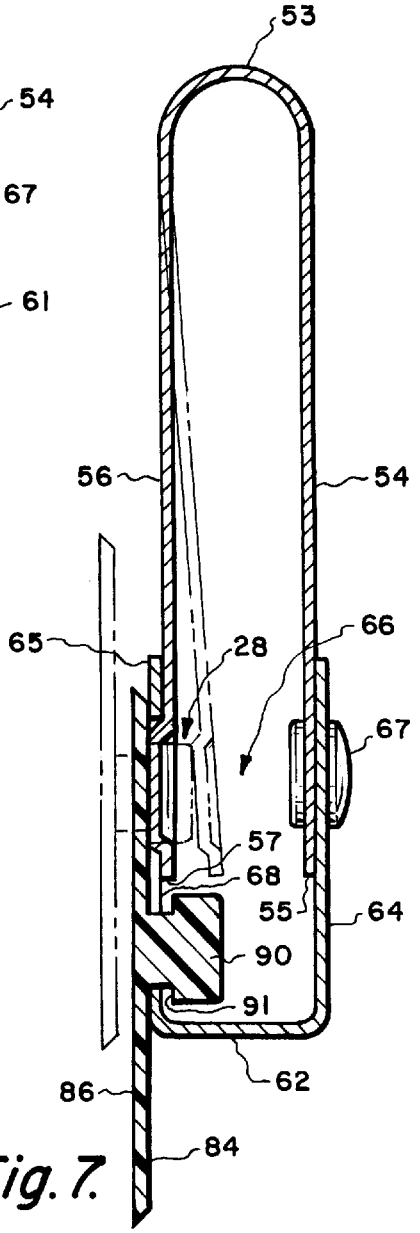
FIG. 7 is an enlarged cross-sectional view taken along lines 7—7 of FIG. 6 showing in phantom the flexure of the flex wall section when the enlarged head extends through the enlarged opening.

Each of the above-described connector means will work with the bent strip clasp means shown by reference 52 in FIGS. 5–7. In this version, a thin flexible strip of material is bent about 180 degrees creating a bent end 53 from which extends a back wall section 54 and a deflectable wall section 56.

The strip of material may be constructed of flexible plastic or metal. Preferably, the bent end corresponds to about the mid-point of the overall strip length so that the respective end edges 55,57 of each wall section will be coextensive.

A cup part 60 is used to provide a stationary wall and enclose end edges 55,57. The cup part comprises opposing cup end walls 61,61 and bottom wall 62. The end walls and bottom wall interconnect rear wall 64 and front wall 65. The aforementioned walls define an open top container with an interior 66. The open interior permits placement of the lower portions of the back wall section and the deflectable wall section. As shown, the lower portion of the back wall section is secured to the inside of rear wall 64 with rivets 67.

The cup front wall mid-portion is provided with an enlarged cup opening 70. The cup opening is preferably circular in shape with a diameter greater than the aforementioned enlarged heads 90,112. It is located above the end edge 57 so that the lower portion of the deflectable wall section will enclose the opening.

Communicating with the cup opening is cup slot 72 which terminates at a closed slot end 73. The cup slot has a width less than the diameter of the cup opening and greater than the diameter of post 88. The slot extends from the cup opening downwardly a predetermined distance below terminal end edge 57.

In the preferred embodiment shown, the outer surface of the lower end portion of the deflectable wall section is provided with a tab 74. The tab projects into the enlarged cup opening and facilitates inward flex of the deflectable wall section upon exertion of inward force by head 90 as shown by arrow C in FIG. 5. In this way, the front wall of the cup part functions in the same manner as the lower portion of stationary wall 18. Also, the deflectable wall section functions in the same manner as deflectable wall 22.

The area between the spaced-apart wall sections above the cup part provides an open passage 76. This construction allows the bent strip clasp 52 to accommodate a support body such as the belt 36 shown in FIG. 1.

Operation of the clasp means and connector parts is the same in all versions of the invention. The deflectable wall is moved away from the respective enlarged openings to permit entry of the enlarged heads and subsequent movement into the slots. The deflectable walls may be flexed by direct manual force or by pushing the enlarged head against the deflectable wall. Once the head passes through an opening, its axial direction will be stopped by the engagement of front face 84 (or boss face 108) against the lower part of either the stationary wall 18 or the front wall 65. In this position, the post 88 (or shank 110) may be moved from the opening into a respective slot as shown by arrow D in FIG. 2. When the post approaches the closed end of the slot, terminal end 24 (or end edge 57) will be free to move past the head back into an unflexed position.

As shown in FIG. 7, the deflectable wall section 56 will return to its unflexed position against the inside surface of front wall 65. In the embodiment of FIGS. 1–4, deflectable wall 22 does not return to its original unstressed condition. It returns until abutment end 25 engages the periphery of enlarged head 90 as shown in FIG. 4. This abutment connection prevents vertical movement within slot 30 and provides for a rattle-free, more stable connection with the accessory connector part.

Figure 14:
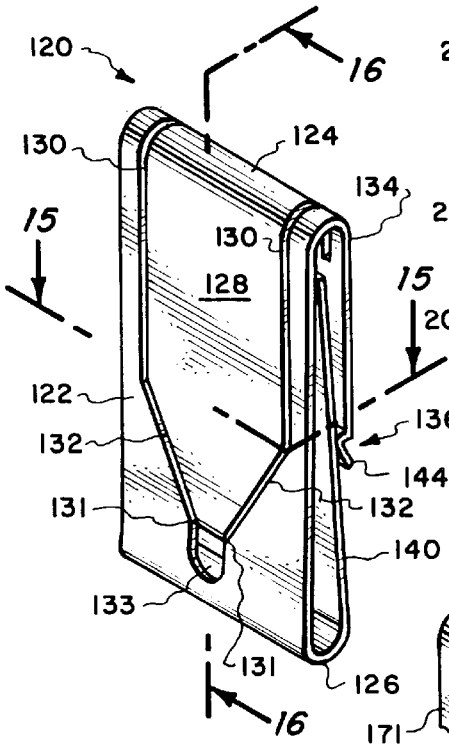
FIG. 14 is a front isometric view of a modified version of the clasp shown in FIG. 2.

A variation of the clasp shown in FIGS. 1–4 is illustrated in FIG. 14. This variation, shown generally by reference 120, utilizes a flexible strip of material in its construction rather than an endless loop as shown in FIGS. 1–4. In this way, terminal ends of the strip may coact and form and integral support body engagement means.

Figure 16:
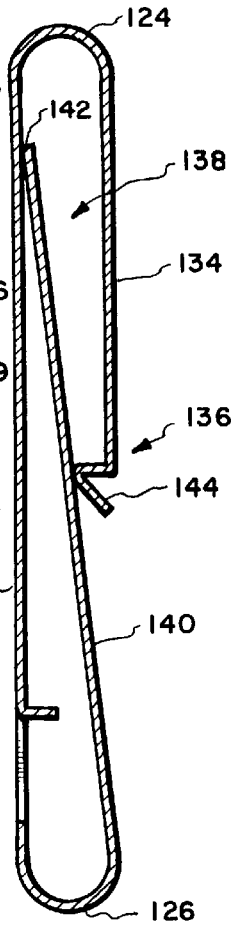
FIG. 16 is an enlarged cross-sectional view taken along lines 16—16 of FIG. 14.
Figure 15:
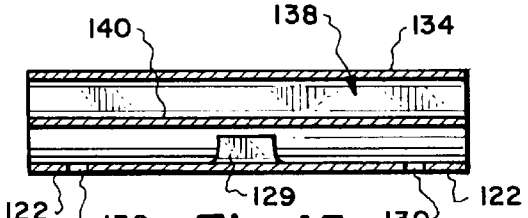
FIG. 15 is an enlarged cross-sectional view taken along lines 15—15 of FIG. 14.

The version shown in FIGS. 14–16 has a flat front face identical to the endless loop version of FIGS. 1–4. It includes a stationary wall 122 extending between a top end 124 and a bottom end 126. A deflectable wall 128 is formed by mirror image parallel cuts 130 and inclined cuts 132. The inclined cuts extend to slot corners 131 to define a slot width. They then curve inwardly to a median merger point. This point defines the bottom of slot 133. The cut-out area above slot corners 131 comprise the previously described enlarged opening 26. The lower region of the deflectable wall comprises the guard portion. It terminates across corners 131 and may include a tab shown as end tab 129.

Although not essential, the parallel cuts are shown extending across top end 124 and a short distance into back wall 134. The back wall extends downwardly from the top end in a manner that is preferably parallel and spaced apart from the stationary wall to a securement end 136. The securement end terminates about midpoint of the overall height of the clasp. However, its exact location is a matter of choice and is dictated by its effectiveness with respect to engagement with a support body in a manner to be hereinafter described. Most typically, it should be at a point within the middle three-fourths of the height of the overall clasp. The area above securement end 136 between the stationary wall and back wall is defined as interior space 138. This space permits backward movement of deflectable wall 128 during the previously described engagement sequence with connector part 80.

Extending upwardly from bottom end 126 is auxiliary wall 140. This wall inclines inwardly toward the back side of stationary wall 122 into space 138. It terminates at free end 142.

The securement end of back wall 134 is provided with a contact means to enhance engagement with a support body such as one's belt or pocket. In such cases, it is preferred that the back wall be sufficiently resilient to bias the securement end toward auxiliary wall 140. As shown, the contact means comprises an inwardly directed angular crease structure 144. Preferably, the crease structure will contact the outer face of auxiliary wall 140. In this way, the crease structure will coact with the auxiliary wall and provide an enhanced frictional engagement with a belt or garment.

As best seen in FIG. 16, the auxiliary wall extends well into the upper region of space 138. However, to coact with the back wall, it is only necessary that free end 142 extend to a point adjacent to crease 144. It will be further noted that the flexible strip material comprising the overall clasp is bent over forming a radius of curvature at the bottom end. This will provide sufficient interior room for unobstructed inward movement of the deflectable wall 128.

Figure 17:
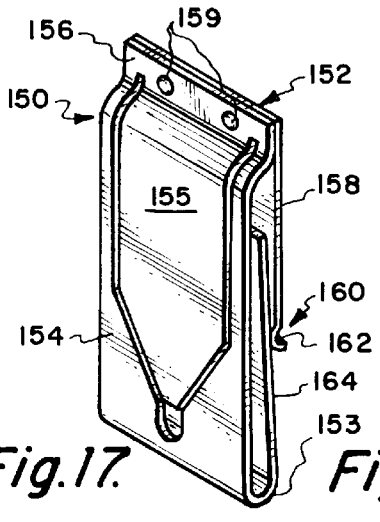
FIG. 17 is a front isometric view of a variation of the clasp shown in FIG. 14 constructed with two clasp components.

A two-part version of the FIGS. 14–16 embodiment is shown in FIG. 17. This version is almost identical to the above single strip design and functions in the same way. However, it is constructed with a separate back wall that is secured to the stationary wall at top end joint 152. This two-part version is shown generally by reference 150. It includes a modified upper end portion of stationary wall 154. This comprises a flat upright portion 156 which is offset back from the plane of the stationary wall.

The stationary wall is provided with the same cut pattern to define deflectable wall 155, an enlarged opening and a slot. The stationary wall merges into bottom end 153. Extending upwardly from the bottom end into the aforementioned interior space is auxiliary wall 164.

Attached to the back side of the upright portion is a clasp member 158. As shown, this comprises a flat resilient material having a width coextensive with the stationary wall width and a length commensurate with that described in relation to back wall 134. It is secured to the upright portion by rivets 159. However, other means such as welding, adhesives and mechanical fasteners would work equally as well.

The clasp member extends downwardly in the same manner and for the same purposes as back wall 134. It is resilient and provides a biasing force toward the auxiliary wall 164 so that a contact means 162 at securement end 160 will provide a means for frictional engagement with a support body. As shown, the contact means is configured to have a inwardly directed rounded shape that flexibly engages the outer face of the auxiliary wall. It will be appreciated that the width, length and shape of the clasp member is a matter of choice dictated by specific product applications, costs and aesthetic considerations.

Figure 19:
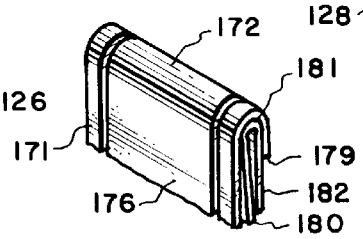
FIG. 19 is a fragmentary front isometric view of a variation of the clasp shown in FIG. 18 illustrating the support wall upper end nested within the stationary wall curved top end.
Figure 18:
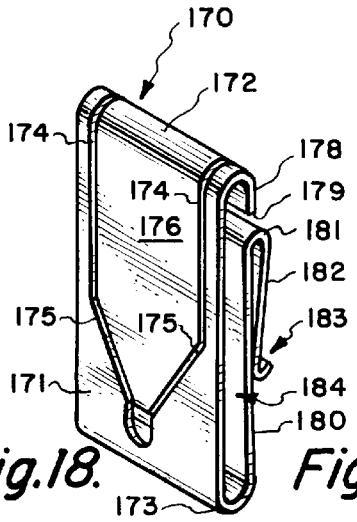
FIG. 18 is a front isometric view of another variation of the clasp shown in FIG. 14 having an integral support body engagement means.
Figure 20:
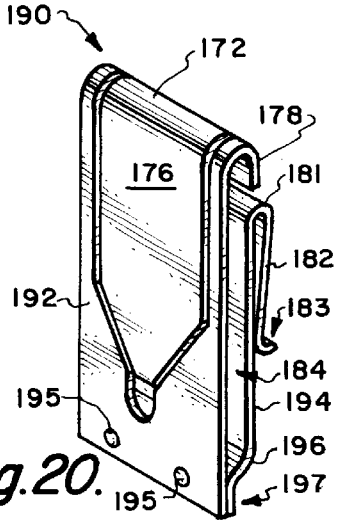
FIG. 20 is a front isometric view of a two-part variation of the clasp shown in FIG. 18.

FIGS. 18–20 show additional variations of the FIGS. 14–16 embodiment. In these variations, the auxiliary wall is bent back to provide an integrated engagement means for a support body. With particular reference to FIG. 18, the overall integrated clasp is shown generally by reference 170. This clasp has the same front structure shown in FIG. 14 comprising a stationary wall 171 extending between a top end 172 and bottom end 173. Parallel cuts 174 and inclined cuts 175 in the stationary wall define deflectable wall 176. As before, the cuts also define a slot and an enlarged opening.

Extending downwardly from top end 172 is an abbreviated back wall referenced as back section 178. Preferably, the top end has sufficient curvature to space apart the back section from the upper front wall structures. This configuration will create an open area therebetween. The back section extends downwardly less than about one-third the clasp length to a terminal end 179.

Extending upwardly from bottom end 173 is support wall 180. In FIGS. 18 and 20, the support wall is shown as extending parallel and coextensive with the stationary wall. It is also spaced-apart from the backside of the stationary wall. This creates a support body space 184. It also provides room for movement of the deflectable wall.

The support wall terminates at an upper end 181. As shown, the upper end is spaced below and apart from back section terminal end 179.

Extending from the upper end is clasp wall 182. The clasp wall extends downwardly to a securement end 183 to define a support body engagement means in the same manner as the contact means described with respect to the embodiment of FIGS. 14–17.

The upper end 181 is preferably rounded and an integral part of at least the support wall and clasp wall. In this way, the clasp wall will have a predetermined radius of curvature and incline inwardly toward the securement wall. As a result of its resilience, the securement end 183 will be biased against the support wall. As shown in FIGS. 18 and 20, the securement end has an outwardly upturned configuration. This is to facilitate insertion of a support body, such as a pocket or belt, between the securement end and the outer face of the support wall.

FIGS. 18 and 20 also show upper end 181 spaced-apart from the terminal end 179 of the back section. This spacing allows passage of a user's belt or strap if desired. FIG. 19 shows an alternative whereby upper end 181 is nested against the curved inside of top end 172. In this alternative, support wall 180 will incline toward the stationary wall 171 and entirely enclose support body space 184.

FIG. 20 shows a two-part clasp 190 that is similar to the FIG. 18 embodiment. However, instead of being constructed of a continuous strip of flexible material with a curved bottom end, the lower end portion of a separate stationary wall 192 is fixed by rivets 195 to the lower end portion of a separate support wall 194. The connection between the parts is referenced as bottom joint 197. Although rivets are shown, other means such as welding, adhesives or mechanical fasteners could be used.

To create the desired support body space 184, the support wall includes a lower outwardly extending shoulder 196. This allows the support wall to be offset from the plane of stationary wall 192.

Figure 21:
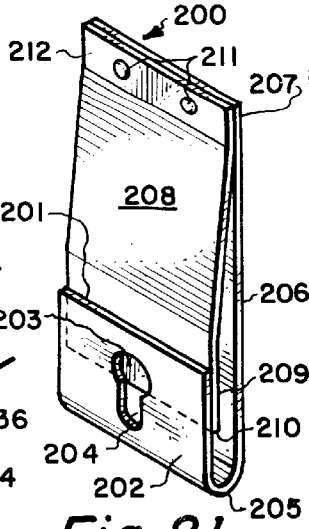
FIG. 21 is a front isometric view of a modified version of the embodiment shown in FIG. 5.

FIG. 21 shows a variation of the FIGS. 5–7 embodiment. This variation is shown generally by J-clasp 200. It comprises a two-piece construction wherein the main body part is shaped to resemble the letter "J". The forward upright component of the "J" comprises front wall 202. The front wall is provided with enlarged opening 203 which, at its lowermost portion, opens into slot 204. This arrangement corresponds to the front wall 65 shown in FIG. 5.

The front wall extends downwardly from front end 201 and merges into a rounded bottom end 205. It then extends upwardly to form rear wall 206. The bottom end is preferably rounded to permit the formation of a space between the front and rear walls. The rear wall terminates at an upper end portion 207. This end portion forms a joint with the corresponding upper end portion 212 of deflectable wall 208.

Preferably, the upper end portion 212 is flat to form a secure joint with the adjacent flat end portion 207 of the rear wall. As shown, the deflectable wall is secured to the upper end portion 207 with rivets 211. However, as mentioned, other equivalent means such as welding, adhesives and mechanical fasteners could be used.

The deflectable wall 208 inclines outwardly away from the inside face of the rear wall and extends downwardly to a lower guard portion 209. The guard portion covers the enlarged opening 203 but terminates at a lower end 210 which extends across the junction of the enlarged opening and slot 204. This arrangement permits the J-clasp to operate with a connector part in the same manner as that shown and described in relation to FIGS. 5–7.

The above-described clasp structures and connector parts provide for a unique quick release interconnection between an accessory item and a support body. This has significant advantage in the use of tools or electronic devices requiring convenient, safe and stable storage of frequently used items while still permitting almost instantaneous accessibility.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A quick release lateral closure system comprising:

a clasp comprising a flexible strip of material which is bent over at a top end and a bottom end to define a stationary wall and a back wall, said stationary wall including an integral deflectable wall defined by opposing cuts through said stationary wall, said deflectable wall having a lower guard portion with a free terminal end;

a slot having a slot width formed in said stationary wall extending from said free terminal end to a closed slot and, said guard portion enclosing an enlarged opening which is defined by said cuts about said guard portion, said enlarged opening becoming exposed when said guard portion is flexed out of said opening;

an auxiliary wall extending upwardly from said bottom end to a position proximate said back wall; and a connector means for releasably interconnecting an accessory item to said clasp, said connector means including an accessory item attached to a post with an enlarged head, said post having a diameter less than said slot width, said head having a diameter less than the diameter of said enlarged opening and greater than said slot width whereby said connector means becomes releasably connected to said clasp by passing said head through said enlarged opening upon deflection of said guard portion and moving said post into said slot.

2. The system of claim 1 wherein said auxiliary wall interacts with said back wall to form a securement means for attaching said clasp to a support body.

3. A clasp structure for an accessory connector part which is constructed of a continuous strip of resilient material comprising:

a stationary wall extending between a top end and a bottom end of said structure;

a slot in said stationary wall for engaging said accessory connector part, said slot having a predetermined slot width;

an enlarged opening in said stationary wall in communication with said slot, said opening defined by predetermined cuts in said stationary wall having a diameter greater than said slot width;

a deflectable wall defined by said predetermined cuts which is integral with said stationary wall, said deflectable wall having a guard portion obstructing access to said enlarged opening from said slot;

a support wall extending upwardly from said bottom end; and a back wall extending down from said top end which interacts with said support wall to form a securement means for attaching said clasp to a support body.

4. The structure of claim 3 wherein said securement means includes a securement end which is biased toward said support wall.

5. The structure of claim 3 wherein said support wall is spaced apart from said stationary wall.

6. The structure of claim 3 wherein said support wall merges into an upper end; and, a clasp wall extending downwardly from said upper end.

7. In a quick release closure system comprising a clasp and a clasp connector wherein the improvement comprises a clasp constructed of:

a continuous strip of flexible material having a predetermined length extending from a back wall to a curved top end from which extends a stationary wall that is spaced-apart from said back wall;

said stationary wall merging into a curved bottom end from which extends an upwardly directed auxiliary wall;

said stationary wall including a deflectable wall defined by opposing cuts through said stationary wall, said deflectable wall having a lower guard portion with a free terminal end;

a slot having a slot width formed in said stationary wall extending from said free terminal end to a closed slot end, said guard portion enclosing an enlarged opening which is defined by said cuts about said guard portion, said enlarged opening becoming exposed when said guard portion is flexed out of said opening; and, said back wall and auxiliary wall co-acting to form a securement means for attaching said clasp to a support body.

8. The system of claim 7 wherein the area between said spaced-apart stationary wall and back wall define an interior space, said auxiliary wall terminating at a free end which extends into said space.

9. The system of claim 7 wherein said back wall terminates at a securement end which is biased toward said auxiliary wall.

10. The system of claim 7 wherein said auxiliary wall merges into an upper end; and, a clasp wall extending downwardly from said upper end.

11. The system of claim 10 wherein said upper end and top end are adjacent to each other.

* * * * *